United States Patent [19]

Woodlief et al.

[11] 4,256,937

[45] Mar. 17, 1981

[54] ELECTROMAGNETIC CONTACTOR ARC CHUTE

[75] Inventors: Frederick E. Woodlief, Lexington; Gene E. DeAmicis, Greenville, both of S.C.

[73] Assignee: Square D Company, Palatine, Ill.

[21] Appl. No.: 916,317

[22] Filed: Jun. 16, 1978

[51] Int. Cl.[3] ..... H01H 33/02

[52] U.S. Cl. ..... 200/144 R; 200/147 R

[58] Field of Search ..... 200/144 R, 144 A, 144 C, 200/147 R, 147 A, 147 B, 148 C, 149 R, 306; 335/132, 198, 201

[56] References Cited

U.S. PATENT DOCUMENTS

| | | | |
|---|---|---|---|
| 2,071,595 | 2/1937 | Trofimov | 200/147 R |
| 2,147,430 | 2/1939 | Ellis et al. | 200/144 R X |
| 2,285,643 | 6/1942 | Beiersdorf et al. | 200/147 R |
| 2,443,521 | 6/1948 | Scott, Jr. | 200/147 R |
| 2,836,683 | 5/1958 | Souchet | 200/147 R X |
| 3,525,059 | 8/1970 | Schramm et al. | 335/132 |

*Primary Examiner*—James R. Scott

*Attorney, Agent, or Firm*—Michael J. Femal

[57] ABSTRACT

An arc chute for a clapper-type electromagnetic D.C. contactor having a closed off top wall with tapered and angled holes therethrough directing jets of air, caused by the arc when the contact tips separate, to the front of the arc chute thereby preventing the arc from moving directly above the contactor and as a result decreasing overhead clearance between contactors and, further improving the upper limit on fault current interruptions.

4 Claims, 4 Drawing Figures

ELECTROMAGNETIC CONTACTOR ARC CHUTE

BACKGROUND OF THE INVENTION

This invention relates to an arc chute for a contactor and more particularly, to an arc chute for extinguishing the arc formed upon opening of the electrical contacts on a D.C. clapper-type contactor in such a manner as to materially decrease the overhead clearance required between contactors mounted on a panel and to improve the upper limit on fault current interruptions.

Generally speaking, prior art arc chute designs on D.C. contactors direct the arc approximately at a 45° angle out of the arc chute. Although the arc is controlled and extinguished without materially damaging the parts of the contactor and the arc chute itself, the arc extends above the contactor increasing the spacing necessary between contactors mounted on the same panel. This extension of the arc above the contactor uses up valuable panel space. Moreover, the prior art arc chute designs lack high upper limits on fault current interruptions.

The closest prior art believed to be pertinent to the present invention is set forth in Schramm et al U.S. Pat. No. 3,525,059 and Trofimov U.S. Pat. No. 2,071,595, both of which disclose an arc chute design for electromagnetic D.C. contactors as described above and their features are incorporated herein by reference to show the type of contactor structure upon which the present invention arc chute would be suitable for removably mounting thereon. However, neither patent discloses a means for ensuring a decrease in overhead clearance spacing between contactors mounted on a panel enclosure or for improving the upper limit on the fault current interruptions.

SUMMARY OF THE INVENTION

With this invention, the foregoing problems are substantially solved. An arc chute for a D.C. electromagnetic contactor which prevents the arc from extending thereabove as well as improves the upper limit on the fault current interruptions includes a unique arc shaping feature different from prior art arc chute designs. This arc shaping feature is accomplished by closing off the large openings on the top wall of the arc chute. Then a plurality of smaller tapered holes are formed in the top wall of the arc chute and the holes are pitched at approximately a 45° angle toward the front of the arc chute and extend in a line generally intermediate the side walls of the arc chute. Although the holes are generally round in the present invention, the holes may take other configurations such as rectangular.

Due to the pressures created by high current interruptions in the arc chute, the holes angled toward the front of the arc chute send jets of air in the same directon. The jets of air keep the arc from moving directly above the contactor and possibly striking another contactor mounted on the panel thereabove. Although the physical principles involved are still unknown to the inventors, it is theorized by them that the holes also divide the arc into smaller voltage increments. This makes the arc easier to extinguish and tends to improve fault current interruption capacity of the arc chute. In fact on one application, the upper limit on fault current interruptions was quadrupled by adding the holes as mentioned above. It has also been found that the number of holes, their size, angle, and spacing therebetween varied with different size D.C. contactors. In addition, the holes in the arc chute have been found useful on all NEMA size 1 through 8 contactors. Moreover, the holes in the arc chute according to the invention were found to have a larger impact on the smaller size contactors than the larger ones.

Accordingly, an object of the present invention is to provide an arc chute for a D.C. electromagnetic contactor that directs the arc to the front thereof and thus decreases overhead clearance required between contactors mounted on a panel while improving the upper limit on fault current interruptions.

BRIEF DESCRIPTION OF THE DRAWINGS

Other objects and advantages will become apparent from the description wherein reference is made to the accompanying drawings illustrating the preferred embodiments of the invention, and in which.

DESCRIPTION OF THE PREFERRED EMBODIMENT

Figure 1:
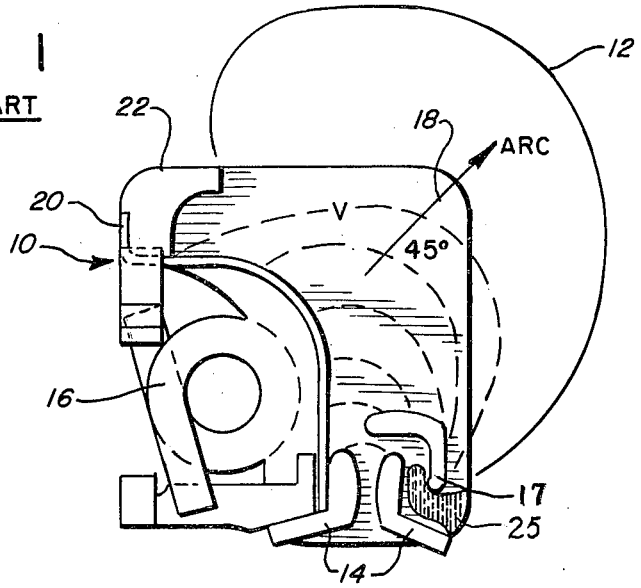
FIG. 1 PRIOR ART
FIG. 1 is a partially sectioned side view of a portion of a prior arc chute design showing the arc extinguishing characteristics thereof.

Referring to FIG. 1, an arc chute 10 made according to a prior art design shows successive arc streams (in dashed lines) moving upwardly and directed away from contactor tips 14 before extinguishing after a line 12 representing the last arc stream position by a blow-out coil 16, an arc dissipating plate 17, and an arc runner 20 at a 45° angle 18 out of and above a top 22 of the arc chute 10. As shown in FIG. 1, the prior art arc chute design permits the arc stream 12 to extend a considerable distance above the top 22 of the arc chute and the contactor structure itself thereby requiring a greater spacing between contactors mounted on a panel.

Figure 2:
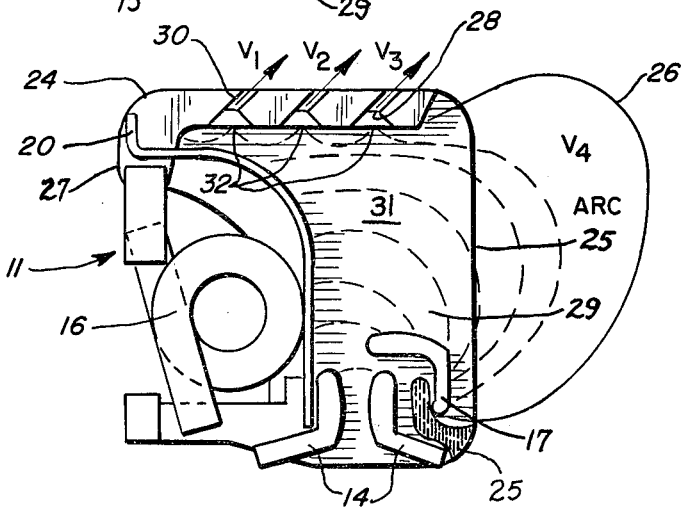
FIG. 2 is a partially sectioned side view of a portion of the arc chute incorporating the arc extinguishing characteristics in accordance with the present invention taken along line 2—2 of FIG. 3.

In FIG. 2, an arc chute 11 made in accordance with this invention is shown. Arc chute 11 can be used on electromagnetic D.C. contactors like the one shown in U.S. Pat. No. 3,525,059, in which an arc occurs between the contact tips 14 when the circuit is broken and the contact tips separate. A blow-out coil 16, an arc dissipating plate 17, and an arc runner 20 direct the arc upwardly and away from the contact tips 14, one which is stationary and the other which is movable, in a manner which is well known in the art.

In a clapper-type contactor, the movable contact tip is typically interconnected with an armature which is spring biased toward one position and magnetically moved to another position for controlling the opening and closing of the contact tips 14 by armature movement. Moreover, the contactor usually includes a removable arc chute such as arc chute 11. While arc chute 11 may take one of many forms well known in the art, the preferred embodiment of the arc chute 11 comprises two complimentary portions as shown by a line 15 molded of suitable arc-suppressing material, which are secured to each other in assembled relationship by fastening means such as shown in U.S. Pat. No. 3,525,059. Although not illustrated in the drawings, the arc chute 11 could be provided with conventional internal baffles which assist in extinguishing the arc.

Figure 4:
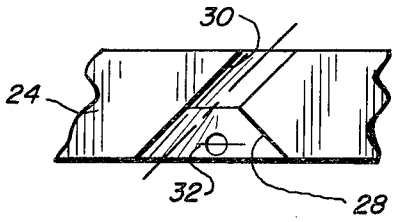
FIG. 4 is an enlarged partial cross-section of an arc chute hole taken along line 4—4 of FIG. 3.

The assembled arc chute 11 includes a top wall 24, a front portion 25, a rear portion 27 and a pair of arc shield side walls 29 defining a chute chamber 31. The arc rises upwardly in a plane between the arc shields 29 in the chute chamber 31, so that there is practically no contact between the hot arc and the side walls 29. The top wall 24 further includes a predetermined number and size of spaced apart tapered holes 32 therethrough. The holes 32 taper in a direction away from the chute chamber 31. Each hole 32 in the top wall 24 includes a truncated lower section 28 and an angled and smaller upper section 30. The lower and upper sections 28 and 30, respectively, each extend approximately one half the thickness of the top wall 24. The larger plane of the truncated lower section 28 opens into the chute chamber 31 while the smaller plane connects to the smaller upper section 30 of approximately the same dimension as the smaller plane of the lower truncated section 28. A portion of the lower section 28 in conjunction with the upper section 30 of each hole 32 is angled toward the front portion 25 of the arc chute 11 at approximately a 45° angle with reference to the larger plane of the truncated lower section 28 as shown more clearly in FIG. 4.

Figure 3:
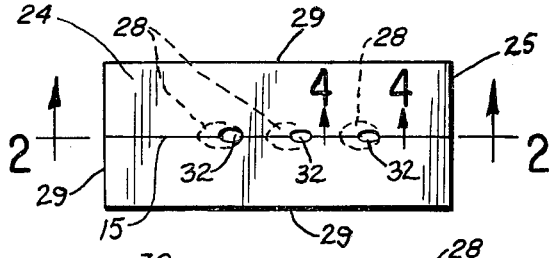
FIG. 3 is a top view of the arc chute in FIG. 2 incorporating the holes therethrough.

As seen in FIG. 3, one half of each hole 32 is on one complementary portion of the arc chute 11 and the other half is on the second cmplementary portion. Therefore, the holes 32 are intermediate the shield side walls 29 and extend in a line from the front to rear portions 25 and 27, respectively, of the arc chute. The size, angle and configuration of the holes 32 may vary depending upon the NEMA size of the D.C. contactor. In the present invention, the holes 32 are generally round in configuration.

Referring to FIG. 2, it is well known that on interrupting the current flow with D.C. contactors or the like, an arc is formed between the current carrying contact tips 14, with the result that heat and air pressures are created within the arc chute chamber 31. Since the top wall 24 of the arc chute 11 is closed off except for the small tapered holes 32, the arc stream extinguishing after a line 26 representing the last arc stream position is directed toward the front portion 25 and out an opening thereon. Meanwhile, the smaller angled and tapered holes 32 in the top wall 24 permits jets of air to be expelled out of the arc chute chamber 31 toward the front portion 25. These jets of air keep the arc from moving directly above the contactor top wall 24 and possibly striking another contactor mounted on a panel thereabove.

In addition, it is theorized that the holes 32 further split the arc into smaller voltage increments such as $V_1$, $V_2$, $V_3$ and $V_4$ as shown in FIG. 2. This makes the arc easier to extinguish and also raises the upper limit of fault current interruptions.

In summary, the arc chute of the present invention provides a means for decreasing the overhead clearance required between D.C. contactors mounted on a panel because the arc is controlled, shaped and prevented from going above the contactor and additionally provides a means for improving the upper limit on fault current interruption capacity by splitting the arc into smaller voltage increments making the arc easier to extinguish.

We claim:

1. An arc chute for controlling, shaping and extinguishing an arc formed by the separation of the current carrying contact elements in a contactor which interrupts the current flowing between the contact elements, said arc producing heat and air pressures, the improvement comprising:

a pair of arc shielding side walls;

a front portion connected to the side walls and having an opening therethrough for passing the arc;

a rear portion connected to the side walls; and a top wall connected to the front and rear portions as well as the side walls defining a chute chamber therewith, said top wall having a predetermined number and size of spaced apart and tapered holes therethrough extending in a line intermediate the side walls from the front to rear portions and angled toward the front portion for directing jets of air thereto to keep the arc from moving directly above the top wall and for splitting the arc into smaller voltage increments to make it easier to extinguish the same and to increase the upper limit of fault current interruptions.

2. The arc chute of claim 1, wherein the holes taper in a direction away from the chute chamber, said holes have a truncated lower section and a smaller upper section approximately the same dimensions as the smaller plane of the truncated lower section in which each section extends approximately one half the thickness of the top wall.

3. The arc chute of claim 1, wherein the holes on the top wall are angled at approximately a 45° angle toward the front portion.

4. The arc chute of claim 1, wherein the top and side walls and the front and rear portions define an arc chute comprised of two complimentary portions, molded of suitable arc-suppressing material and fastened together, with one half of each hole on one of the complementary portions and the other half of each hole on the second complementary portion.

* * * * *